US009451837B2

(12) United States Patent
Heinavaara et al.

(10) Patent No.: US 9,451,837 B2
(45) Date of Patent: Sep. 27, 2016

(54) TEMPERATURE CONTROLLED DISPLAY CABINET, IN PARTICULAR A FREEZER ISLAND, COMPRISING A DOOR

(71) Applicant: Norpe Oy, Porvoo (FI)

(72) Inventors: Kimmo Heinavaara, Valko (FI); Mikko Mykkanen, Vantaa (FI)

(73) Assignee: NORPE OY, Porvoo (FI)

( * ) Notice: Subject to any disclaimer, the term of this patent is extended or adjusted under 35 U.S.C. 154(b) by 0 days.

(21) Appl. No.: 14/526,810

(22) Filed: Oct. 29, 2014

(65) Prior Publication Data

US 2015/0121931 A1 May 7, 2015

(30) Foreign Application Priority Data

Nov. 1, 2013 (FI) ..... 20136075
Mar. 28, 2014 (FI) ..... 20145294

(51) Int. Cl.
*A47F 3/04* (2006.01)

(52) U.S. Cl.
CPC ..... *A47F 3/043* (2013.01)

(58) Field of Classification Search
CPC .... A47F 3/0434; A47F 3/043; A47F 3/0439; A47F 3/0447
USPC ..... 312/138.1, 116, 139; 62/246, 251
See application file for complete search history.

(56) References Cited

U.S. PATENT DOCUMENTS

| | | | | |
|---|---|---|---|---|
| 1,128,620 | A | 2/1915 | Muenzner | |
| 1,855,953 | A | 4/1932 | Friedrich | |
| 2,973,631 | A | 3/1961 | Adkins | |
| 3,125,864 | A * | 3/1964 | Ural | A47F 3/0443 62/248 |
| 4,430,770 | A | 2/1984 | Niekrasz | |
| 4,844,567 | A | 7/1989 | Chalabian | |
| 5,116,274 | A * | 5/1992 | Artwohl | A47F 3/007 312/116 |
| 5,639,149 | A * | 6/1997 | Grassmuck | A47F 3/007 277/645 |
| 8,468,836 | B2 | 6/2013 | Tuszkiewicz et al. | |
| 2008/0047912 | A1 * | 2/2008 | Cianetti | A47F 3/007 211/119.004 |
| 2010/0293746 | A1 * | 11/2010 | Johansson | A47B 88/0481 16/85 |

FOREIGN PATENT DOCUMENTS

| | | |
|---|---|---|
| GB | 2161540 | 1/1986 |
| WO | 2013170466 | 11/2013 |

OTHER PUBLICATIONS

FI Office Action, dated Oct. 7, 2015; Application No. 20136075.
Finnish Search Report dated Jul. 10, 2014, corresponding to the Foreign Priority Application No. 20136075.
Finnish Office Action dated Oct. 20, 2014, corresponding to the Foreign Priority Application No. 20145294.

* cited by examiner

*Primary Examiner* — Matthew Ing
(74) *Attorney, Agent, or Firm* — Young & Thompson

(57) ABSTRACT

A temperature controlled display cabinet (20), in particular a freezer island, for a grocery store includes a frame structure (30) surrounding at least one openable product space (23) for food products, at least one gravitationally closable door (26) that is in inclined position in relation to vertical direction such that from the view of the customer side the main direction of the main surface of the door (26) is backwards and upwards inclined. The door (26) is formed as a door arrangement including the door (26) and an opening and closing mechanism (40).

20 Claims, 10 Drawing Sheets

TEMPERATURE CONTROLLED DISPLAY CABINET, IN PARTICULAR A FREEZER ISLAND, COMPRISING A DOOR

FIELD OF THE INVENTION

The present invention relates to a temperature controlled display cabinet, advantageously to a semi-vertical temperature controlled display cabinet and more especially the invention relates to a temperature controlled display cabinet, in particular a freezer island, comprising a gravitationally closable door.

BACKGROUND OF THE INVENTION

Temperature controlled display cabinets are used mostly in grocery stores and in food establishments, such as restaurants, cafeterias etc. Temperature controlled display cabinets comprise different types of cabinets for displaying and making available food products, groceries etc. for customers, in particular for self-service shopping. The display cabinets can be refrigerated cabinets, freezers or warmed cabinets. For example freezer islands are used in grocery stores for frozen food products and they are located in middle of the floor space of the store so that customers have access to the product space around the island at least from the longitudinal sides of the island. In some cases freezer islands may be located next to a wall or another structure so that accessibility is only from one longitudinal side of the island.

One disadvantage of the freezer island of these types is limited visibility of products: products located near walls can only be seen if the customers stand right next to the freezer island and can have a look directly from above and shorter customers, for example children, may not have visibility over the walls at all. Another disadvantage relates to ergonomics of customer, especially in cases where the freezer island is located so that accessibility is from one longitudinal side only. The customer may have to reach out to an awkward almost back horizontally bent position in order to reach a product located near the bottom of the product space away from the wall that the customer is standing next to. The product space of these types of freezer islands according to prior art is limited in vertical direction by the height of the walls that have a maximum in order to save accessibility of the customer to the products.

The gravitationally closable doors of temperature controlled display cabinet, in particular of a freezer island, might cause as disadvantage that the door might be heavy for customers to open and that the door might hit the cabinet frame hard if uncontrollably closed. Uncontrollable closing of the door may also cause danger to customers, for example hand or fingers may remain between the frame of the door and the door.

SUMMARY OF THE INVENTION

An object of the present invention is to create a temperature controlled display cabinet, in particular a freezer island, in which the disadvantages of prior art arrangements are eliminated or at least minimized.

The gravitationally closable doors of temperature controlled display cabinet, in particular of a freezer island, might cause as disadvantage that the door might be heavy for customers to open and that the door might hit the cabinet frame hard if uncontrollably closed.

An object of the present invention is to create a temperature controlled display cabinet, in particular a freezer island, comprising a door, which is gravitationally closable but easily openable.

An object of the present invention is to create a temperature controlled display cabinet, in particular a freezer island, comprising a door, which is gravitationally but softly closable.

A particular, non-limiting object of the invention is to create a temperature controlled display cabinet, in particular a freezer island, in which the visibility of products to customers is good irrespective of location of standing or height of the customer.

A particular, non-limiting object of the invention is to create a freezer island where the reachability of products to customer is good and possible in good ergonomic position.

A particular, non-limiting object of the invention is to create a freezer island with more product space for frozen food products in the product space in relation to floor space need compared to freezer islands according to prior art.

A particular, non-limiting object of the present invention is to create an opening and closing mechanism of a door of a temperature controlled display cabinet in which disadvantages of uncontrollable closing of the door and of heavy opening of the door are eliminated or at least minimized.

In order to achieve the above objects and those that will come apparent later the temperature controlled display cabinet, in particular a freezer island, is mainly characterized by the features of the claims. Advantageous embodiments and features are defined in dependent claims.

According to the invention the temperature controlled display cabinet, advantageously a semi-vertical display cabinet, in particular a freezer island, comprises at least one gravitationally closable door that is in inclined position in relation to vertical direction such that from the view of the customer side the main direction of the surface of the door is backwards and upwards inclined. By customer side is meant the side on which the customer is normally located when picking food products from the cabinet.

The gravitationally closable in inclined position located doors of the temperature controlled display cabinets might cause as disadvantage that the door that comprises a transparent main surface and door frames around it might be heavy for customers to open and that the door might hit the temperature controlled display cabinet, in particular a freezer island, frame hard if uncontrollably closed. For eliminating these possible disadvantages the door is formed as a door arrangement comprising the door and an opening and closing mechanism that ensures that the door is easy to open and closes softly and slow such that the closing speed is below the allowable closing speed defined in relating machine directives, typically for example below 0.2 m/s. The opening and closing mechanism is formed of a spring mechanism and hydraulic means. The hydraulic means slows down closing speed of the door during its closing movement by hydraulic slowing. The spring mechanism assists in opening the door by mechanically lightening the load caused by the door.

One important factor of the opening and closing mechanism of a door of a temperature controlled display cabinet is that there is only limited space available for the opening and closing mechanism and especially due to the need for visibility requirements of the products inside the cabinet in order for the customers to have unlimited visibility of the products the opening and closing mechanism may not block the view.

The opening and closing mechanism of a door of a temperature controlled display cabinet comprises the spring mechanism and the hydraulic means for slowing down closing speed and for assisting the opening of the door. Advantageously the opening and closing mechanism comprises a turning arm mechanism, which is advantageously formed as a turning arm mechanism comprising advantageously at least one telescopic arm.

Advantageously the opening and closing mechanism of a door of a temperature controlled display cabinet is on one hand attached to a frame part of the door and on the other hand attached to the door such that when the door is in closed position the opening and closing mechanism is located inside the temperature controlled display cabinet. More advantageously the opening and closing mechanism is located on the upper part of the door such that the spring mechanism and the hydraulic means are attached to an upper horizontal frame part of the door frame and correspondingly the turning arm mechanism is attached to the upper horizontal part of the door. In this advantageous arrangement the horizontal upper door frame is provided with an opening through which the turning arm mechanism extends from the door to be connected inside the cabinet to the on the door frame inside located spring mechanism and the hydraulic means in order to connect the function of the spring mechanism and the hydraulic means to the opening/closing movement of the door. Advantageously the size of the opening for the turning arm mechanism is optimized in view of temperature control.

Advantageously the hydraulic means and the spring mechanism are located sequentially and such that at least part of the arm of the hydraulic means is located inside the spring spiral. Thus the hydraulic means and the spring mechanism are located at least partially lengthwise within each other. By this space is saved.

According to an advantageous feature the turning arm mechanism comprises at least one J-lever providing the accompanying movement of the door as far as possible and back.

According to an advantageous feature at least part of the surface of the door is transparent.

According to an advantageous feature the door is inclined such that the horizontal component of the inclination angle is smaller than the vertical component of the inclination angle.

According to an advantageous feature the door is inclined in inclination angle at least 15° and less than 25°, advantageously 18-23° in relation to vertical direction.

The surface of the door in relation to vertical direction is straight, broken line or curved, advantageously convex, in view of the customer.

According to an advantageous feature of the invention the temperature controlled display cabinet, in particular a freezer island, comprises a frame structure that has a back wall, a front wall, a base part, side walls and a ceiling part.

According to an advantageous feature the temperature controlled display cabinet is a freezer island comprising two main parts: a shelf part comprising shelves for food products and a chest part below the shelf part. According to an advantageous feature the door is inclined such that at least one shelf of the shelf part is visible in the horizontal direction through the door. According to an advantageous feature the product space of the freezer island comprising the shelf part and the chest part forms a continuous space without limiting horizontal wall or lid structures. According to an advantageous feature of the invention the height of the freezer island is such that an average man can see over the top surface of the ceiling part of the freezer island. According to an advantageous feature of the invention the freezer island comprises two freezer islands according to the invention and it is openable from both longitudinal sides for customers to pick desired frozen food products. Advantageously the freezer island comprises two freezer islands with back walls against each other forming a center wall. According to an advantageous feature of the invention the freezer island has a ceiling part the top surface of which can be used for food products preserved at room temperature. By the advantageous embodiment of the invention a freezer island is created that has good visibility of products that is easy to use by customer in good ergonomic position. Further the freezer island has even 35% more product space for frozen food products in the product space in relation to floor space need compared to freezer islands according to prior art.

BRIEF DESCRIPTION OF THE DRAWINGS

In the following the invention is described in detail with reference to the accompanying drawings, in which in FIGS. 1A-1B are schematically shown two examples of a freezer island according to prior art, in FIGS. 2A-2B is schematically shown one advantageous example of the door arrangement of a temperature controlled display cabinet, in FIG. 3 is schematically shown another advantageous example of the door arrangement of a temperature controlled display cabinet, in FIG. 4 is schematically shown yet another advantageous example of the door arrangement of a temperature controlled display cabinet, in FIG. 5 is schematically shown yet one advantageous example of a temperature controlled display cabinet in FIG. 6 is schematically shown an example of a temperature controlled display cabinet, in particular a freezer island, according to the invention in view from the customer side, in FIG. 7 is schematically shown one example of a temperature controlled display cabinet, in particular a freezer island, according to the invention and in FIGS. 8-10 is schematically shown one advantageous example of the opening and closing mechanism of a door of a temperature controlled display cabinet, in particular of a freezer island or of a refrigerated cabinet.

DETAILED DESCRIPTION OF THE INVENTION

During the course of the following description of FIGS. 2-10 like numbers and signs will be used to identify like elements, parts and part components unless otherwise mentioned. In the following the examples are described by reference to a freezer island in view of simplifying the disclosure but it should be noted that instead of a freezer island any type of a temperature controlled display cabined with a gravitationally closable door can have similar features and properties in accordance with the invention.

Figure 1A:
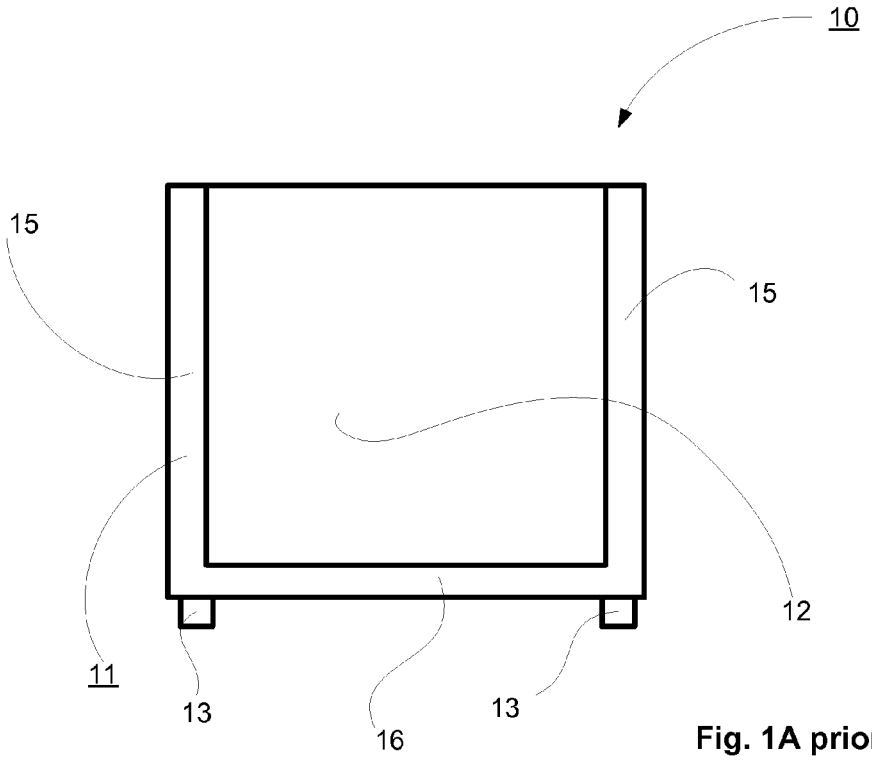
Fig. 1A prior art
Figure 1B:
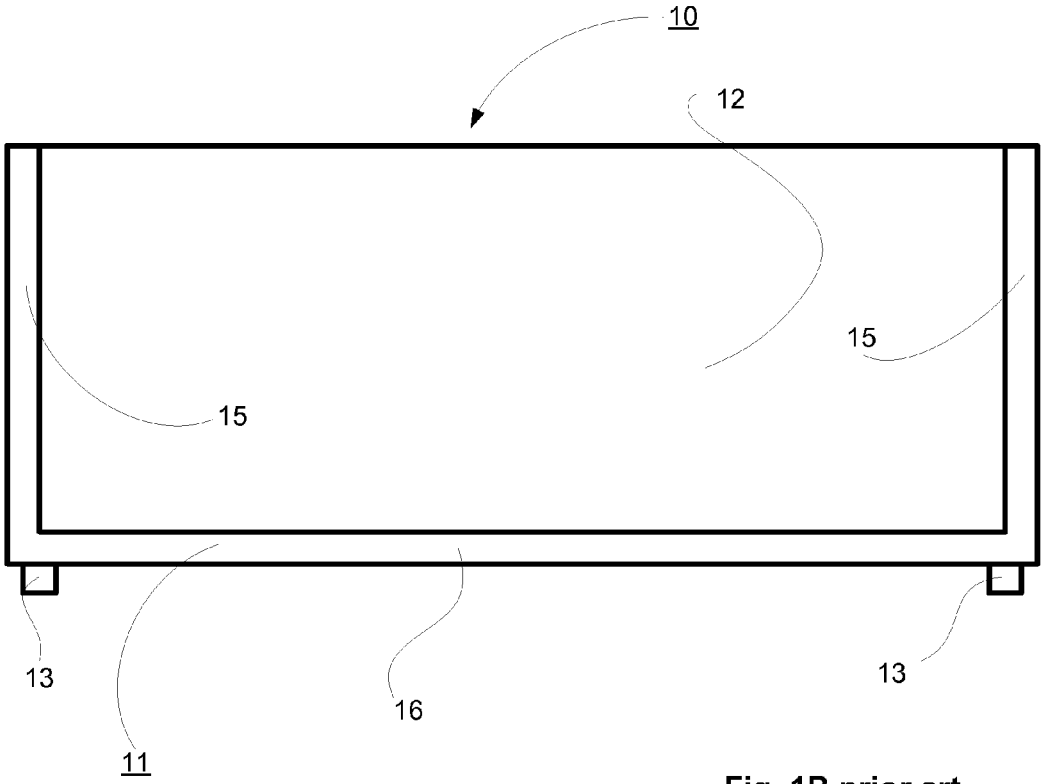
Fig. 1B prior art

In FIG. 1A is shown one example of a freezer island 10 according to prior art which is a narrow freezer island, typically located next to a wall at the grocery store. The freezer island 10 has a box-like appearance and it is open or openable from the top for customers to pick desired food products. The freezer island may have energy saving openable lids, which are typically arranged as sliding lids or as lids hinged from the back i.e. away from the customer located side. The freezer island 10 has a frame structure 11 having walls 15 and a base part 16 surrounding a product space 12 and typically it is supported by feet 13 on the floor of the grocery store. In FIG. 1B is shown another example of a freezer island 10 according to prior art, which is a wide freezer island, typically located at middle of the floor space of the grocery store. The freezer island 10 has a box-like appearance and it is open or openable (it can have energy saving openable lids) from the top for customers to pick desired food products. The freezer island 10 has a frame structure 11 having walls 15 and a base part 16 surrounding a product space 12 and typically it is supported by feet 13 on the floor of the grocery store. Typically width of the narrow freezer island 10 measured from outer surface of opposite longitudinal walls 15 is 800-900 mm and width of the wide freezer island 10 measured from outer surface of opposite longitudinal walls 15 is 1800-1900 mm and height measured from surface of the floor 14 of the grocery store to the upmost point of the frame structure 11 is about 900 mm Typically height of the product space 12 is about 500 mm and width of the product space of the narrow type 700-800 mm and width of the product space of the wide type 1700-1800 mm.

Figure 2A:
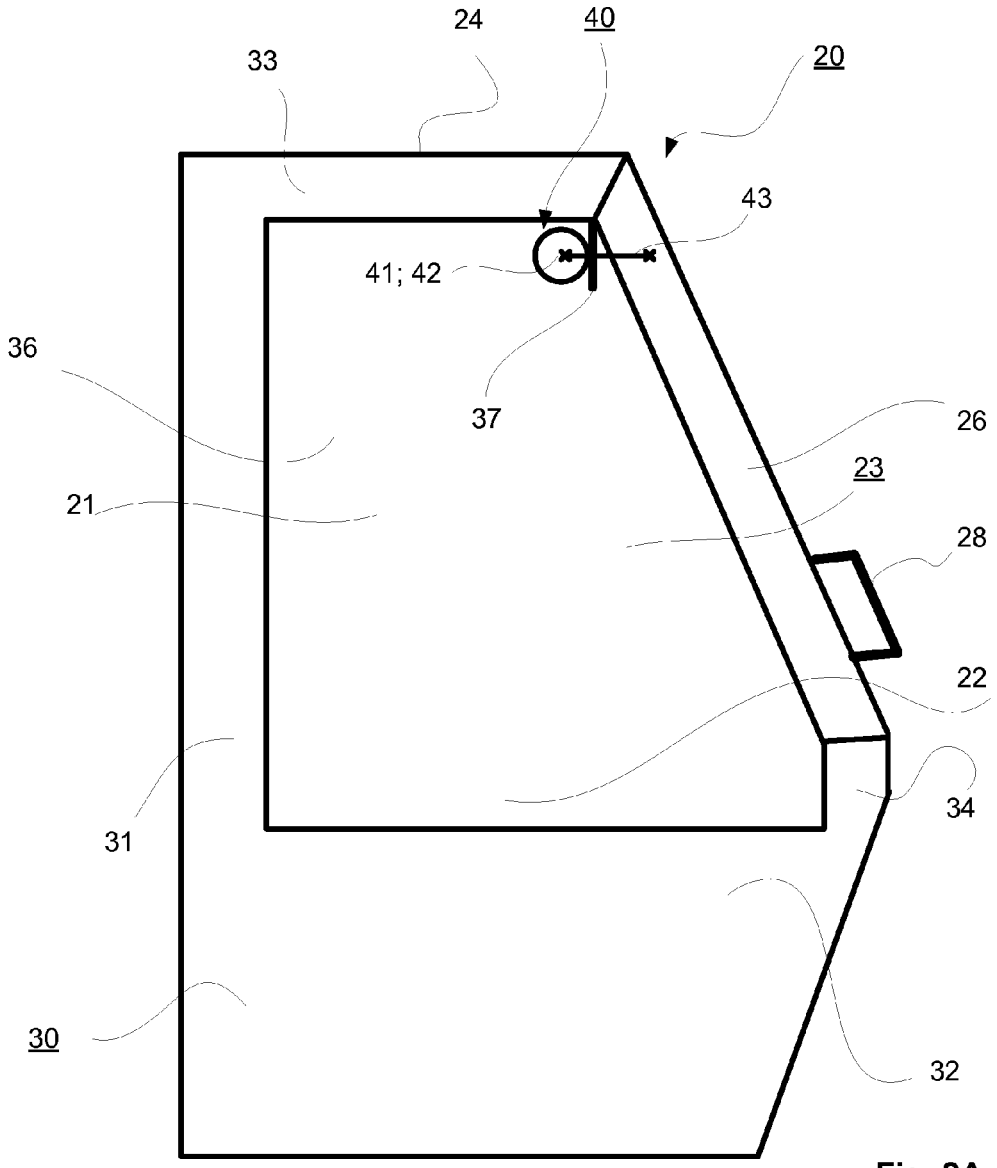
Figure 2B:
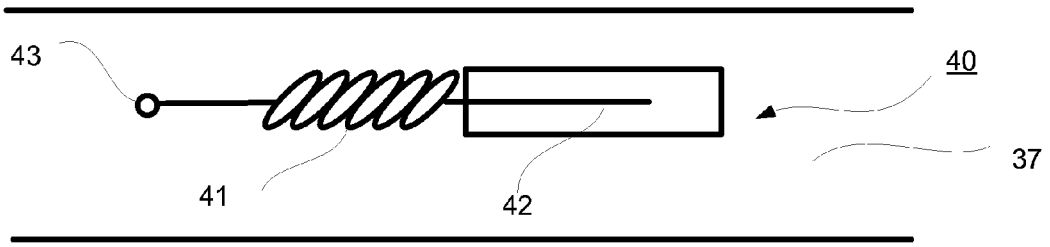

In FIGS. 2A-2B is schematically shown one advantageous example of the door arrangement of a temperature controlled display cabinet 20, in particular a freezer island. The temperature controlled display cabinet, in particular a freezer island 20 has a cabinet-like appearance and it is openable from the front, i.e. from the longitudinal side at customer side, for customers to pick desired food products. The freezer island 20 has a frame structure 30 having a back wall 31, a front wall 34, a base part 32 and a ceiling part 33 and side walls (not shown) surrounding a product space 23. The product space 23 of the freezer island 20 according to this example comprises two main parts for products: a shelf part 21 comprising shelves 27 and a chest part 22 below the shelf part 21. The freezer island 20 has transparent, openable doors 26 that are in inclined position in relation to vertical direction such that from the view of the customer the main direction of the surface of the door 26 is backwards and upwards inclined. The surface of the door 26 in relation to vertical direction can be straight as shown in the example of the figure or broken line or curved, for example convex in view of the customer. The door 26 has a handle 28, for the customer to grip on for opening the door. The door 26 is gravitationally closable door in inclined position in relation to vertical direction for example such that at least one shelf 27, FIG. 6, of the shelf part 21 is visible in the horizontal direction through the door 26 and such that the horizontal component of the inclination angle is smaller than the vertical component of the inclination angle. The door 26 arrangement comprises opening and closing mechanism 40, which comprises a spring mechanism 41 and hydraulic means 42, which are connected to the door 26 by a joint lever mechanism 43 and attached functionally movably to a support wall 37. The hydraulic means 42 slows down closing speed and acceleration of the door 26 during its closing movement and the spring mechanism 41 assists opening the door 26 by lightening the load caused by the door 26. In this example the hydraulic means 42 and the spring mechanism 41 inside the freezer island 20 to the top part of the door 26 and to and to a partition wall 36 in the product space 12 of the freezer island 20.

Figure 3:
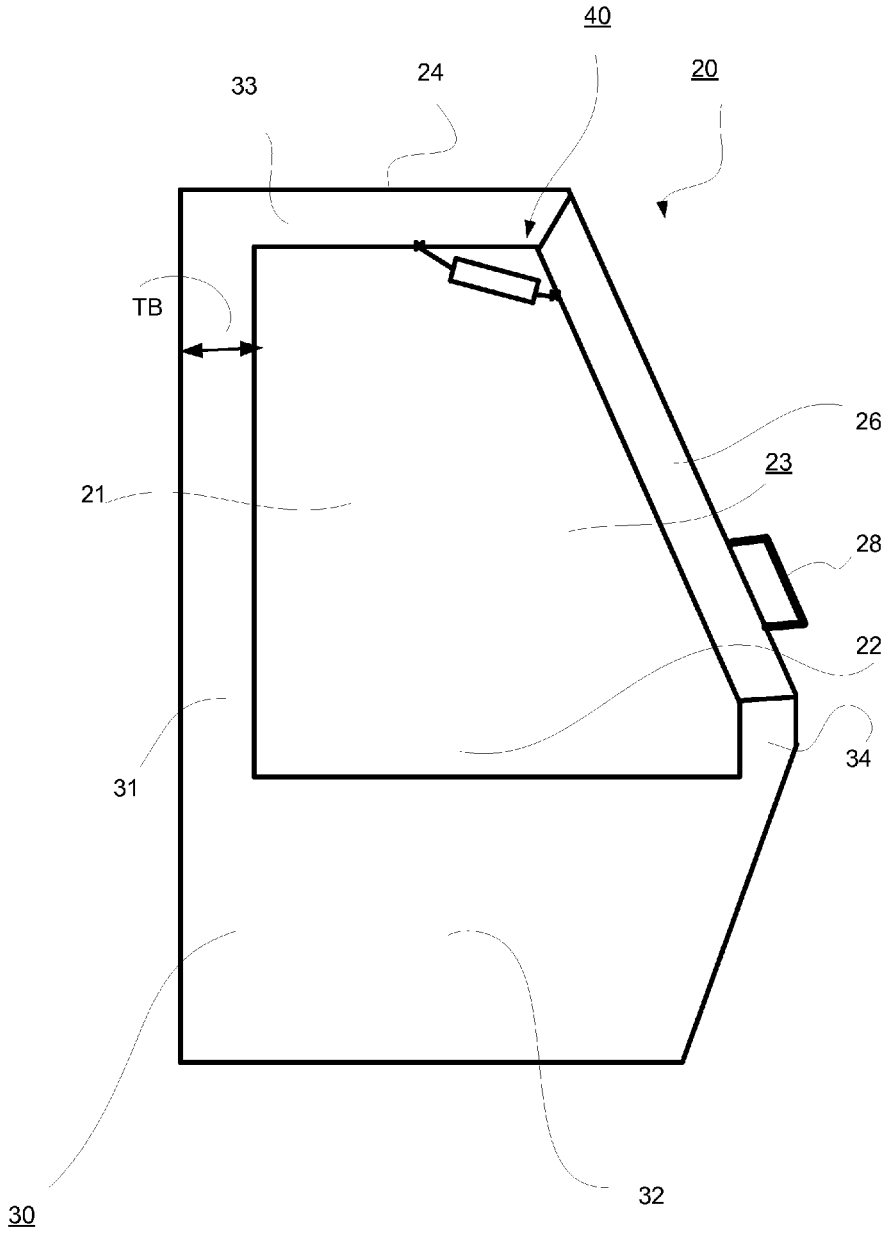

In FIG. 3 is schematically shown one example of the door 26 arrangement of a temperature controlled display cabinet 20, in particular a freezer island. The freezer island 20 has a cabinet-like appearance and it is openable from the front, i.e. from the longitudinal side at customer side, for customers to pick desired food products. The freezer island 20 has a frame structure 30 having a back wall 31, a front wall 34, a base part 32 and a ceiling part 33 and side walls (not shown) surrounding a product space 23. The product space 23 of the freezer island 20 comprises two main parts for products: a shelf part 21 comprising shelves 27 and a chest part 22 below the shelf part 21. The freezer island 20 has transparent, openable doors 26 that are in inclined position in relation to vertical direction such that from the view of the customer the main direction of the surface of the door 26 is backwards and upwards inclined. The surface of the door 26 in relation to vertical direction can be straight as shown in the example of the figure or broken line or curved, for example convex in view of the customer. The door 26 has a handle 28, for the customer to grip on for opening the door. The door 26 arrangement comprises opening and closing mechanism 40, which is arranged as a compact mechanism comprising both an opening mechanism providing easy opening and closing mechanism providing soft closing. The compact opening and closing mechanism is fastened inside the freezer island 20 to the top part of the door 26 and to the inside ceiling part 33. The door 26 is gravitationally closable door in inclined position in relation to vertical direction for example such that at least one shelf 27, FIG. 7, of the shelf part 21 is visible in the horizontal direction through the door 26 and such that the horizontal component of the inclination angle is smaller than the vertical component of the inclination angle.

Figure 4:
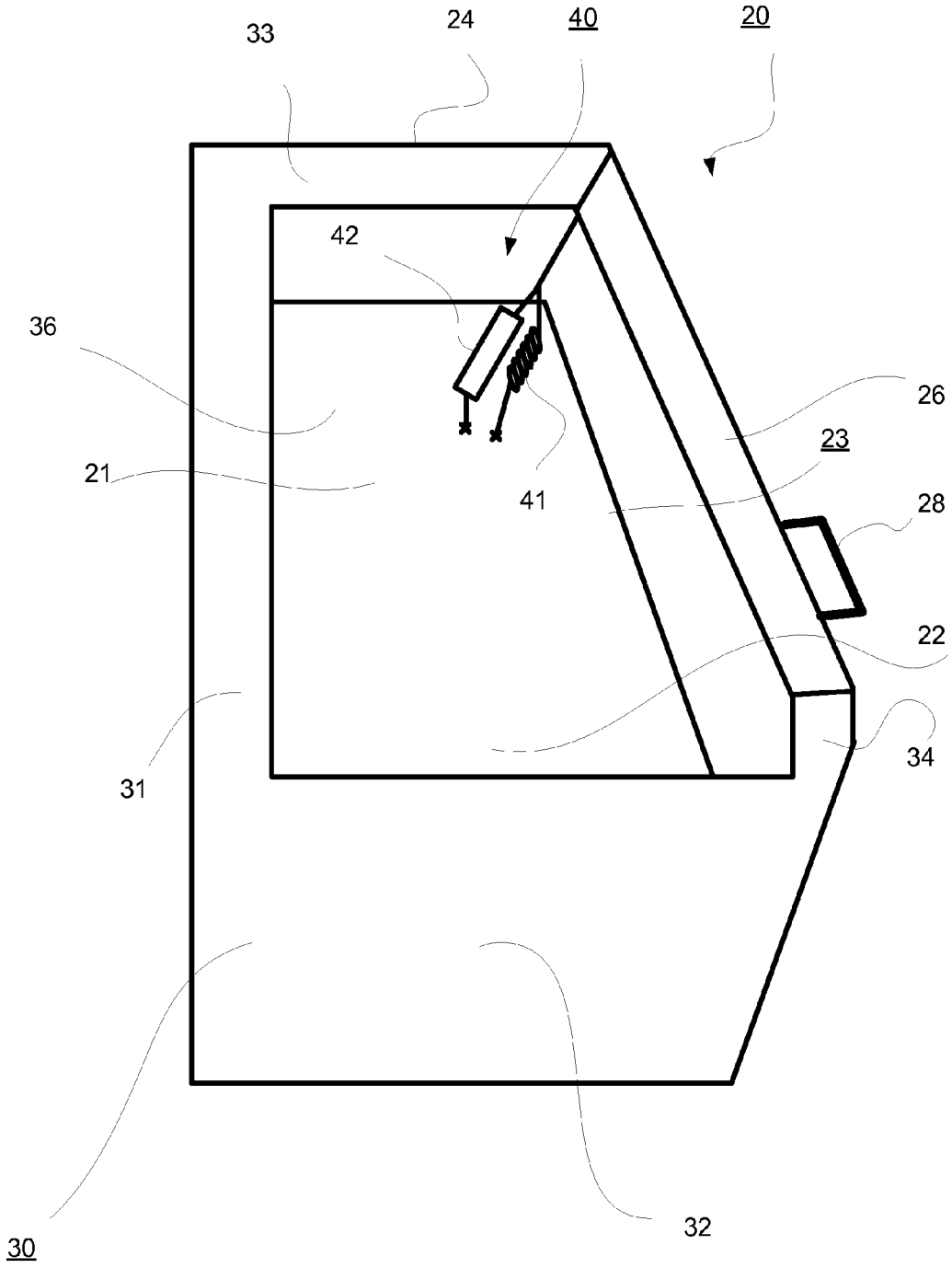

In FIG. 4 is schematically shown one example of the door 26 arrangement of a temperature controlled display cabinet, in particular a freezer island, 20 according to the example of FIG. 2. The freezer island 20 has a cabinet-like appearance and it is openable from the front, i.e. from the longitudinal side at customer side, for customers to pick desired food products. The freezer island 20 has a frame structure 30 having a back wall 31, a front wall 34, a base part 32 and a ceiling part 33 and side walls (not shown) surrounding a product space 23. The product space 23 of the freezer island 20 comprises two main parts for products: a shelf part 21 comprising shelves 27 and a chest part 22 below the shelf part 21. The freezer island 20 has transparent, openable doors 26 that are in inclined position in relation to vertical direction such that from the view of the customer the main direction of the surface of the door 26 is backwards and upwards inclined. The surface of the door 26 in relation to vertical direction can be straight as shown in the example of the figure or broken line or curved, for example convex in view of the customer. The door 26 has a handle 28, for the customer to grip on for opening the door. The door 26 is gravitationally closable door in inclined position in relation to vertical direction for example such that at least one shelf 27, FIG. 6, of the shelf part 21 is visible in the horizontal direction through the door 26 and such that the horizontal component of the inclination angle is smaller than the vertical component of the inclination angle. The door 26 arrangement comprises opening and closing mechanism 40, which comprises a spring mechanism 41 and hydraulic means 42. The hydraulic means 42 slows down closing speed and acceleration of the door 26 during its closing movement and the spring mechanism 41 assists opening the door 26 by lightening the load caused by the door 26. In this example the hydraulic means 42 and the spring mechanism 41 inside the freezer island 20 to the top part of the door 26 and to and to a partition wall 36 in the product space 12 of the freezer island 20.

Figure 5:
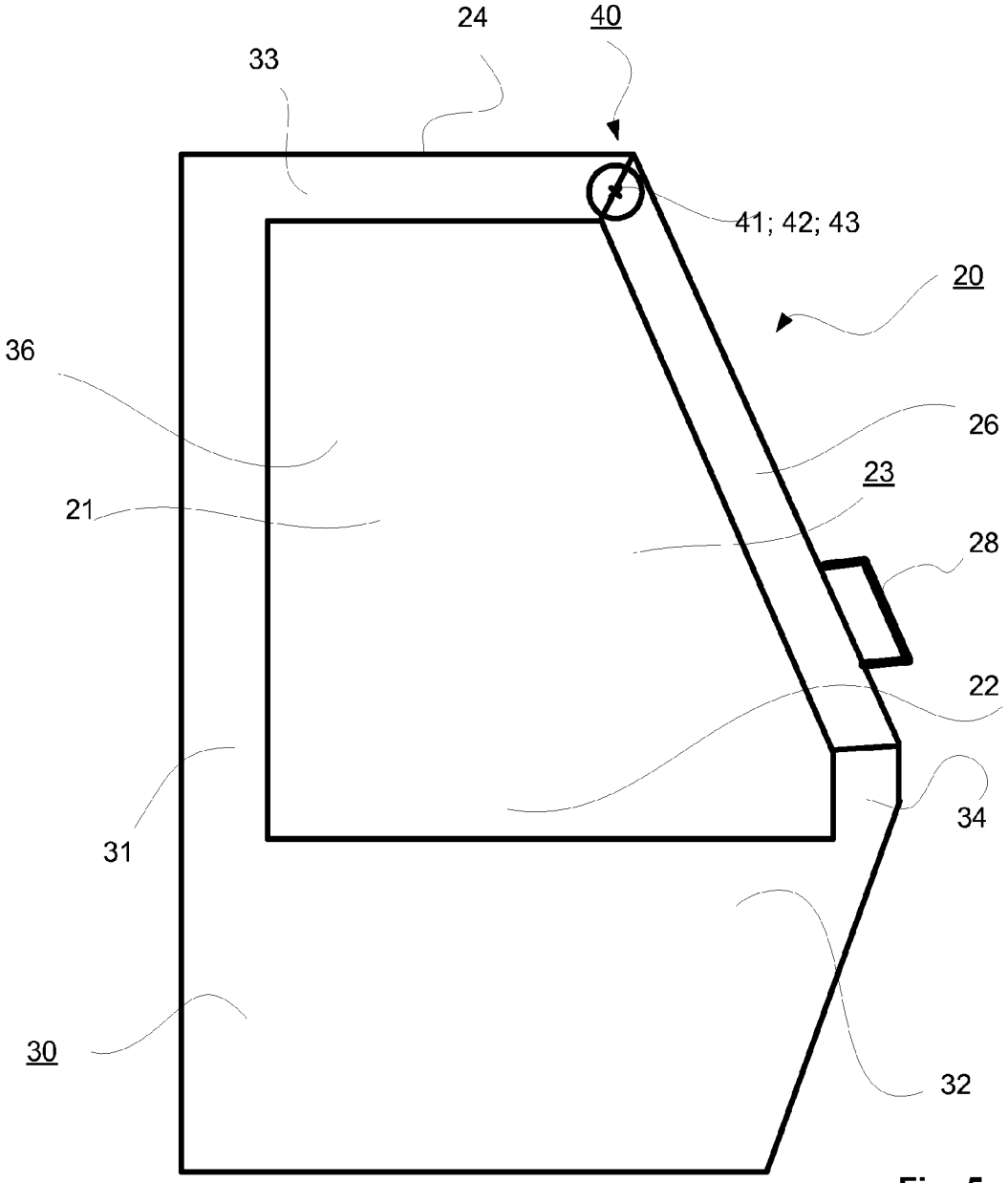

In FIG. 5 is schematically shown one advantageous example a temperature controlled display cabinet 20, in particular a freezer island. The temperature controlled display cabinet, in particular a freezer island 20 has a cabinet-like appearance and it is openable from the front, i.e. from the longitudinal side at customer side, for customers to pick desired food products. The freezer island 20 has a frame structure 30 having a back wall 31, a front wall 34, a base part 32 and a ceiling part 33 and side walls (not shown) surrounding a product space 23. The product space 23 of the freezer island 20 according to this example comprises two main parts for products: a shelf part 21 comprising shelves and a chest part 22 below the shelf part 21. The freezer island 20 has transparent, openable doors 26 that are in inclined position in relation to vertical direction such that from the view of the customer the main direction of the surface of the door 26 is backwards and upwards inclined. The surface of the door 26 in relation to vertical direction can be straight as shown in the example of the figure or broken line or curved, for example convex in view of the customer. The door 26 has a handle 28, for the customer to grip on for opening the door. The door 26 is gravitationally closable door in inclined position in relation to vertical direction for example such that at least one shelf of the shelf part 21 is visible in the horizontal direction through the door 26 and such that the horizontal component of the inclination angle is smaller than the vertical component of the inclination angle. The display cabinet 20 has an opening and closing mechanism 40, which comprises a spring mechanism 41, hydraulic means 42 and a turning arm mechanism 43 and attached functionally movably to the frame structure 30 of the display cabinet 20. The hydraulic means 42 slows down closing speed and acceleration of the door 26 during its closing movement and the spring mechanism 41 assists opening the door 26 by lightening the load caused by the door 26. In this example the hydraulic means 42 and the spring mechanism 41 attached to the top part of the frame structure 47 of the door of the display cabinet 20 and the turning arm mechanism 43 attached to the top part of the door 26 are located inside the freezer island 20.

Figure 6:
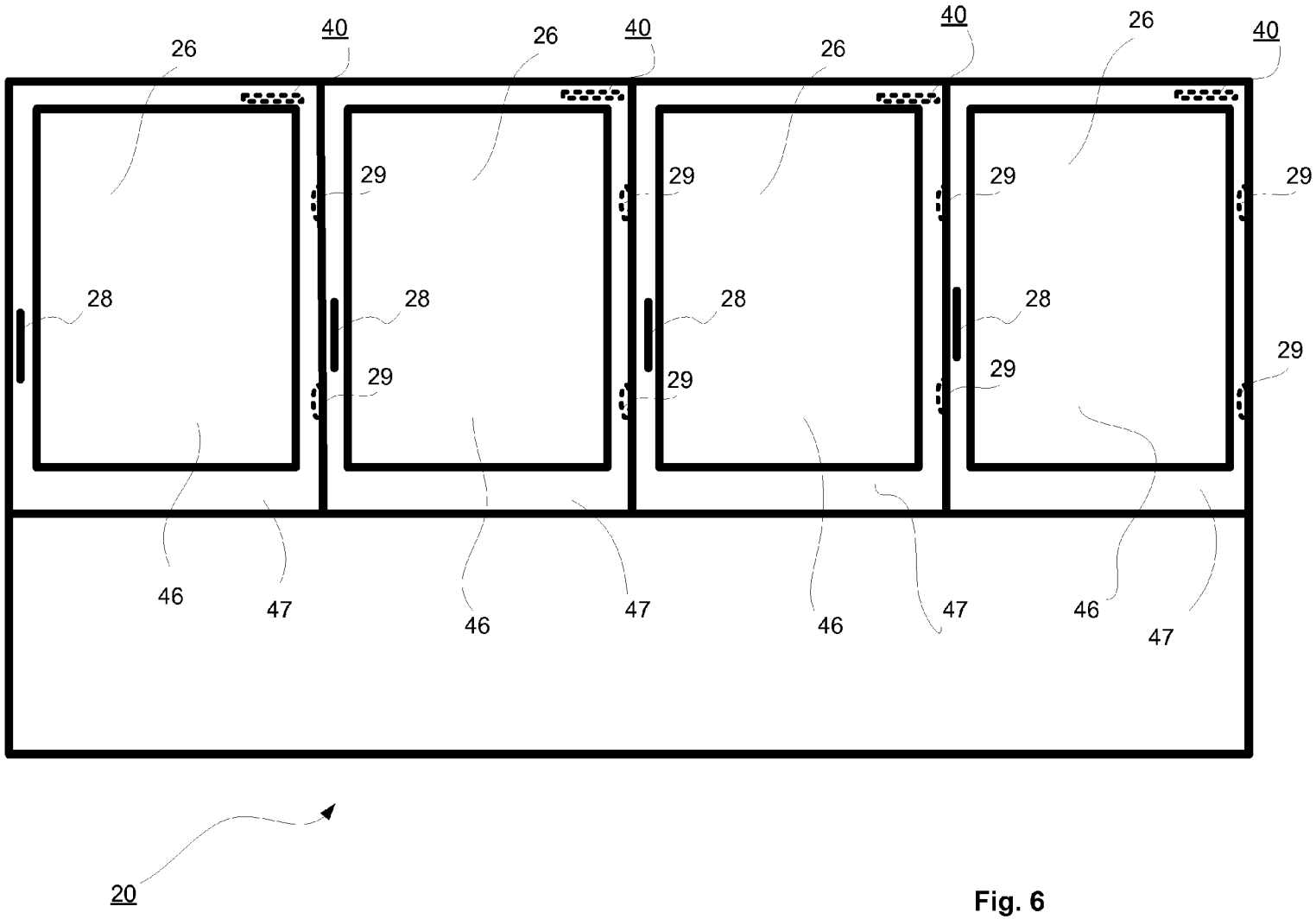

In the example of FIG. 6 the temperature controlled display cabinet, in particular a freezer island, 20 is viewed from the customer side. In this example the freezer island 20 comprises four doors 26 each comprising an opening and closing mechanism 40 and a handle 28. Each door 26 comprises a transparent main surface 46 and door frame 47 around it. The doors 26 have hinges 29 for turnably attaching the doors 26 to frame structure 30, FIG. 2, of the freezer island 20. In this example advantageously the hydraulic means and the spring mechanism attached to the top part of the frame structure of the door of the display cabinet and the turning arm mechanism attached to the top part of the door are located inside the freezer island.

Figure 7:
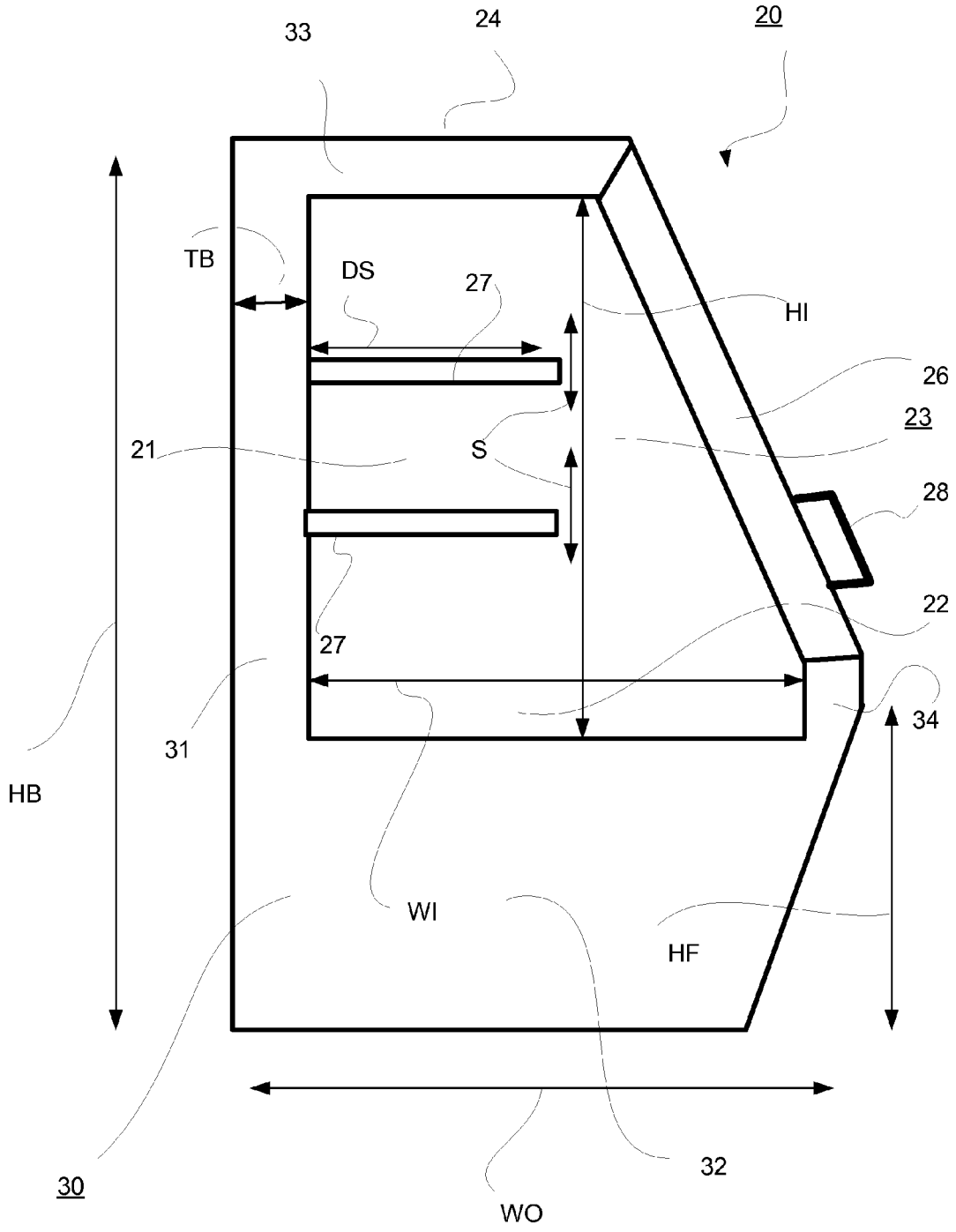

In FIG. 7 is shown one example of a temperature controlled display cabinet, in particular a freezer island, 20 according to the invention. The freezer island 20 has a cabinet-like appearance and it is openable from the front, i.e. from the longitudinal side at customer side, for customers to pick desired frozen food products. The freezer island 20 has a frame structure 30 having a back wall 31, a front wall 34, a base part 32 and a ceiling part 33 and side walls (not shown) surrounding a product space 23. The product space 23 of the freezer island 20 comprises two main parts for products: a shelf part 21 comprising shelves 27 and a chest part 22 below the shelf part 21. The freezer island 20 has transparent, openable doors 26 that are in inclined position in relation to vertical direction such that from the view of the customer the main direction of the surface of the door 26 is backwards and upwards inclined. The surface of the door 26 in relation to vertical direction can be straight as shown in the example of the figure or broken line or curved, for example convex in view of the customer. The door 26 has a handle 28, for the customer to grip on for opening the door. The height of the freezer island 20 is such that an average man can see over the top surface 24 of the ceiling part 33 of the freezer island 20. The height HB (back height) of the freezer island 20 measured from surface of the floor is advantageously 1300-1700 mm and the width WO (outer width) of the freezer island 20 according to this example measured from outer surface of the back wall 31 to the outermost point of the front wall 34 is 1000-1200 mm. The height HI (inside height) of the product space 23 is 800-1200 mm and the maximum width WI (inside width) of the product space 23 is 700-900 mm. The height HF (front height) of the base part 32 measured from the floor of the store is 400-600 mm. The shelf depth DS of the shelves is about 400 mm and thickness of the back wall TB is about 150 mm. In this example the freezer island 20 has a horizontal top surface 24 of the ceiling part 33 which can be used for food products preserved at room temperature.

Figure 8:
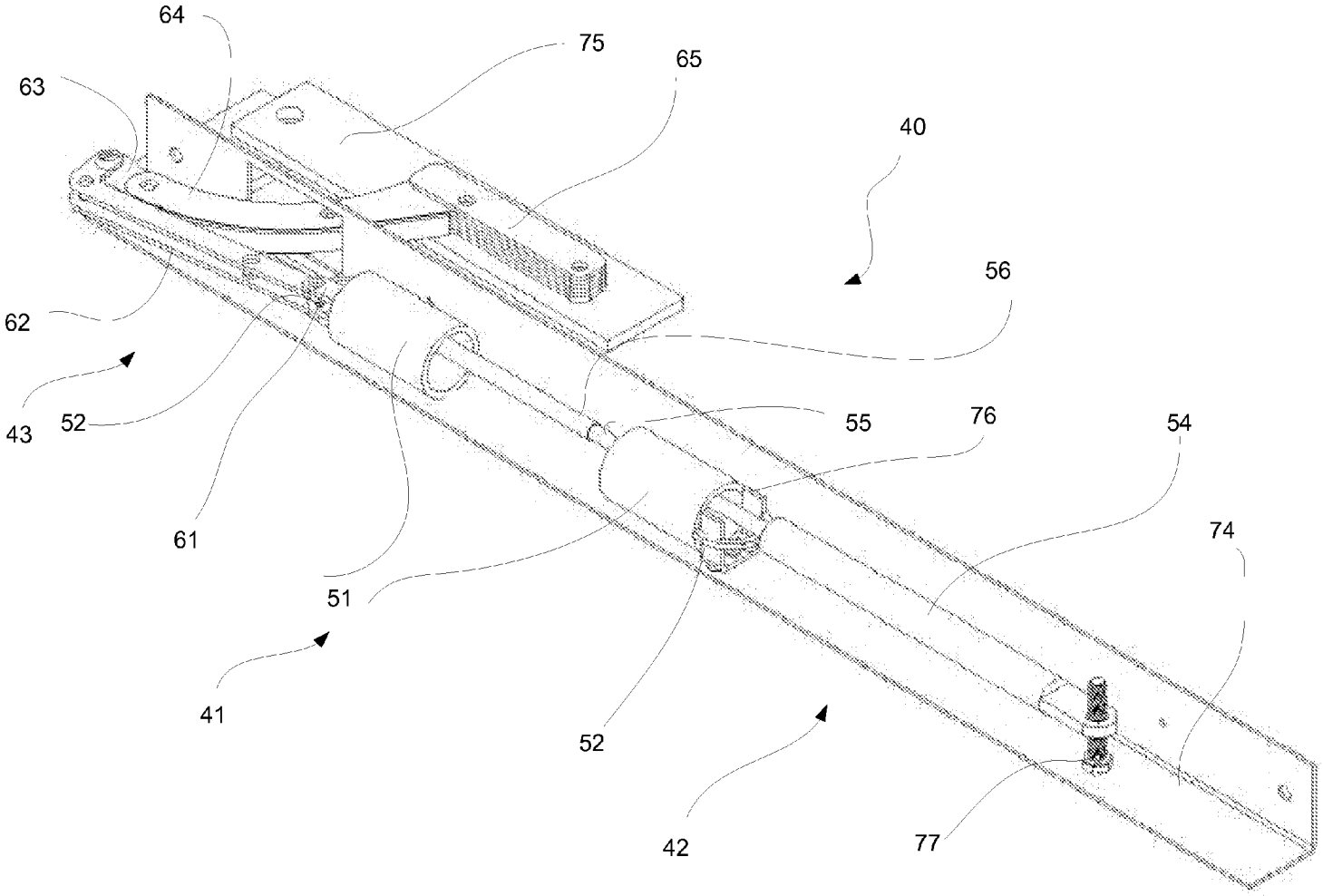
Figure 9:
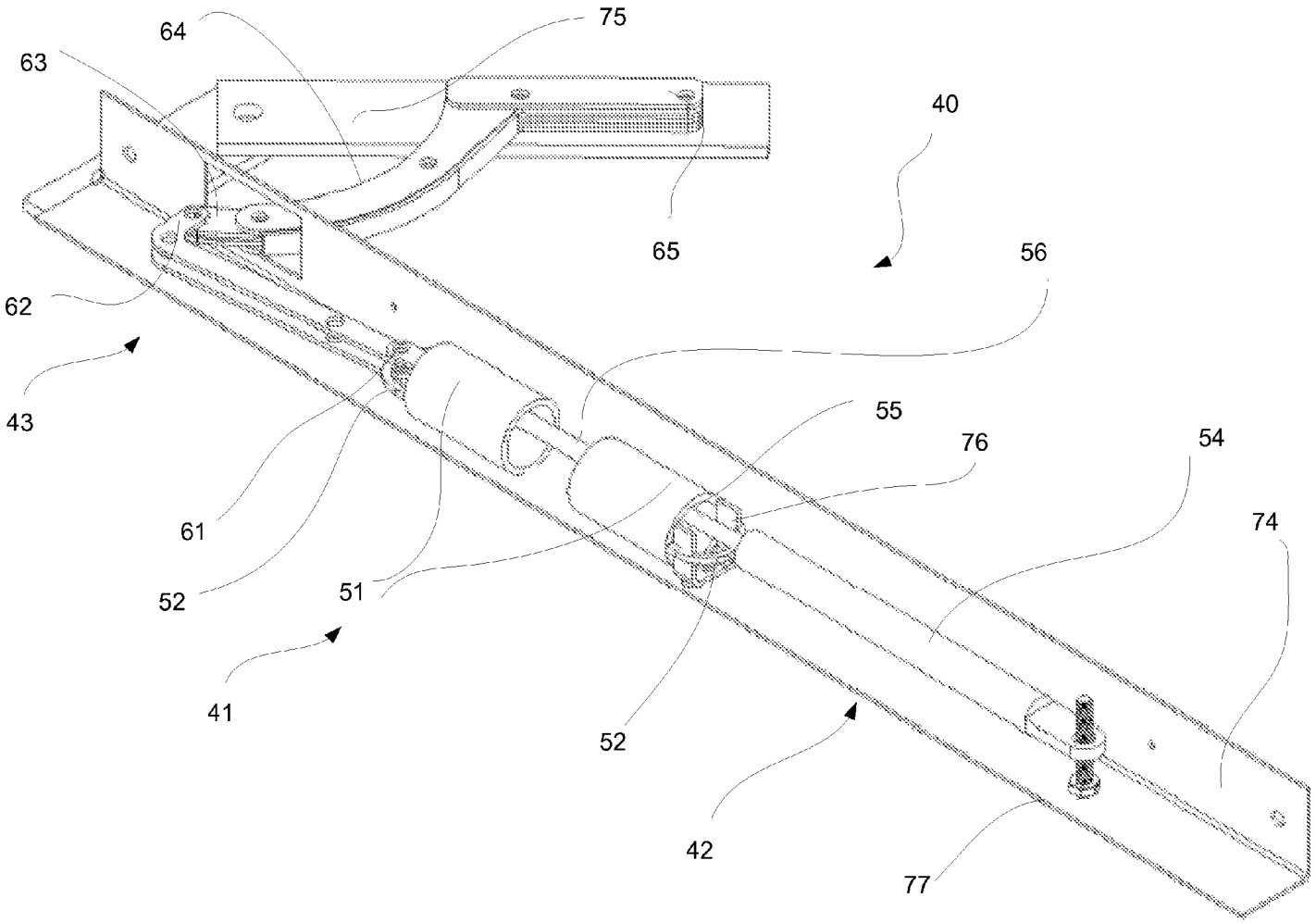
Figure 10:
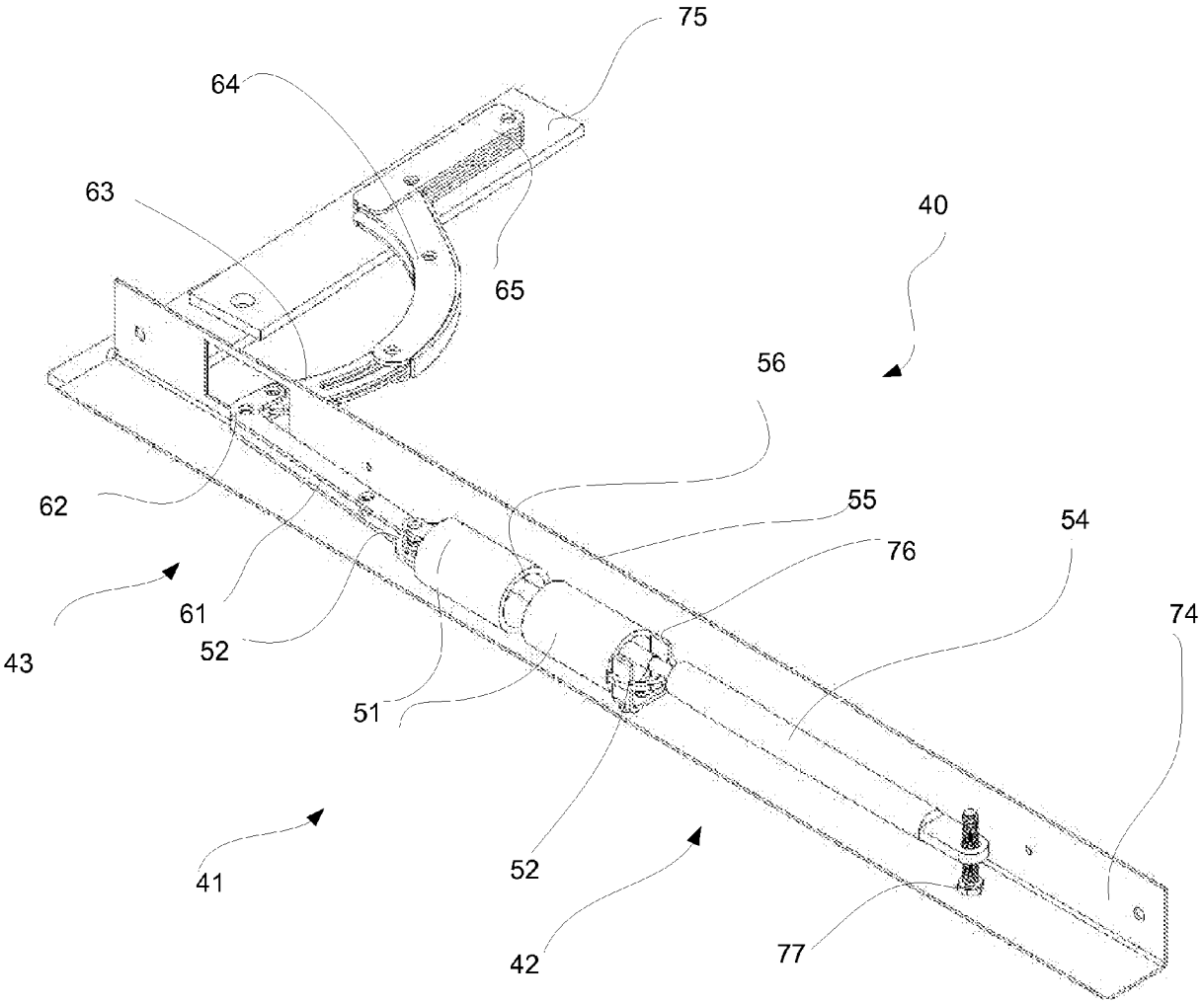

In FIGS. 8-10 is shown an advantageous example of the opening and closing mechanism 40 of a door 26 of a temperature controlled display cabinet 20. The opening and closing mechanism 40 comprises a spring mechanism 41, hydraulic means 42 and a turning arm mechanism 43. The hydraulic means 42 slows down closing speed and acceleration of the door during its closing movement and the spring mechanism 41 assists opening the door by lightening the load caused by the door.

In the example of FIGS. 8-10 of the opening and closing mechanism 40 the hydraulic means 42 comprise a cylinder 54 and arm/arms 55, 56, the spring mechanism 41 is a spiral spring 51 with attachment ends 52 and the turning arm mechanism 43 comprises an idler 61 connected at first end to one attachment end 52 of the spiral spring 51 and at the second end to a J-lever 62, which in turn is attached at its arched end to the inner part 63 of the telescopic lever, which inner part 63 is arranged movably in the outer part 64 of the telescopic lever connected to attachment part 65, which is attached to the connecting part 75, which will connect the opening and closing mechanism 40 at one end to the door of the temperature controlled display cabinet. The inside parts of the opening and closing mechanism 40 are supported by another connecting part 74, which will connect the opening and closing mechanism 40 at the other end to the door frame of the temperature controlled display cabinet. The hydraulic means 42 are attached at opposite end in respect of the arm 55 by fastening means 77 to the connecting means 74. The spring means 41 are attached at one end to fastener 76 attached to the connecting means 74 and at the other end to the idler 61 of the turning arm mechanism 43. The arm 56 of the hydraulic means 42 is also connected to the idler 61. The telescopic levers 63, 64 have an arcuate shape in order to provide an arc-like movement path corresponding to the angular movement of the door. The J-lever 62 functions for providing the accompanying movement of the door as far as possible and back. The hydraulic means 42 and the spring mechanism 41 are located sequentially and such that at least part of the arm 55, 56 of the hydraulic means 54 is located inside the spring spiral. Thus the hydraulic means 42 and the spring mechanism 41 are located at least partially lengthwise within each other. The arms 55, 56 can be constructed of two arms 55, 56 as explained above or constructed of one arm only.

In FIG. 8 the opening and closing mechanism 40 is shown in position where the door is closed i.e. the opening angle of the door is 0°. In this position the hydraulic means 42 have the arms 55, 56 at the longest positions and the spring means 41 is in tensioned state and the telescopic lever 63, 64 is at closed position.

In FIG. 9 the opening and closing mechanism 40 is shown in position where the door is partly opened and the opening angle of the door is 45°. In this position the hydraulic means 42 have the arm/arms 55, 56 at partly closed positions and the spring means 41 is in partly tensioned state and the telescopic lever 63, 64 is at position. The function of the telescopic lever 63, 64 begins when movement of the spring means 41 stops entirely.

In FIG. 10 the opening and closing mechanism 40 is shown in position where the door is fully opened and the opening angle of the door is 90°. In this position the hydraulic means 42 have the arm/arms 55, 56 at the shortest positions and the spring means 41 is in untensioned state and the telescopic lever 63, 64 is at opened position.

When the door is closed the movements of the opening and closing mechanism 40 function at respective but opposite order in view of the opening movements functions explained above in view of FIGS. 8-10.

REFERENCE SIGNS USED IN THE DRAWING

10 freezer island, prior art
11 frame structure, prior art
12 product space, prior art
13 foot, prior art
15 wall, prior art
16 base part, prior art
20 temperature controlled display cabinet, in particular a freezer island,
21 shelf part
22 chest part
23 product space
24 top surface of the ceiling part
26 door
27 shelf
28 handle
29 hinge
30 frame structure
31 back wall
32 base part
33 ceiling part
34 front wall
35 center wall
36 partition wall
37 support wall
40 opening and closing mechanism
41 spring mechanism
42 hydraulic means
43 joint lever mechanism
46 main surface of the door
47 door frame
51 spring
52 attachment end of the spring
54 cylinder of the hydraulic means
55 arm of the hydraulic means
56 arm of the hydraulic means
61 idler
62 J-lever
63 inside part of the telescopic lever
64 outside part of the telescopic lever
65 lever attachment part
74 connecting part
75 connecting part
76 fastening means
77 fastener
HB back height; center height
HF front height
HI inside height
WO outer width
WI inside width
DS shelf depth
TB thickness of the back/center wall

The invention claimed is:

1. A temperature-controlled display cabinet that is a freezer island for a grocery store including a frame structure surrounding at least one openable product space for food products, the temperature-controlled display cabinet that is the freezer island comprising:

at least one gravitationally closable door that is in an inclined position in relation to a vertical direction such that, from the view of the customer side of the cabinet, the main direction of the main surface of the door is backwards and upwards inclined, the door being formed as a door arrangement comprising the door, hinges configured to turnably attach the door to the frame structure, and an opening and closing mechanism, which is formed of a spring mechanism configured to assist opening the door by lightening the load caused by the door and a hydraulic system configured to slow down a closing speed of the door during closing movement thereof.

2. The temperature-controlled display cabinet according to claim 1, wherein the door comprises a transparent main surface and a door frame around the main surface.

3. The temperature-controlled display cabinet according to claim 2, wherein the door is inclined such that the horizontal component of the inclination angle is smaller than the vertical component of the inclination angle.

4. The temperature-controlled display cabinet according to claim 1, wherein the door is inclined such that the horizontal component of the inclination angle is smaller than the vertical component of the inclination angle.

5. The temperature-controlled display cabinet according to claim 1, wherein the door is inclined in an inclination angle of at least 15° and less than 25° in relation to the vertical direction.

6. The temperature-controlled display cabinet according to claim 5, wherein the door is inclined in an inclination angle of 18-23° in relation to the vertical direction.

7. The temperature-controlled display cabinet according to claim 1, wherein the product space of the temperature controlled display cabinet comprises a shelf part comprising shelves and a chest part below the shelf part.

8. The temperature-controlled display cabinet according to claim 7, wherein one shelf of the shelf part is visible in the horizontal direction through the door.

9. The temperature-controlled display cabinet according to claim 8, wherein the product space of the temperature controlled display cabinet comprising the shelf part and the chest part forms a continuous space.

10. The temperature-controlled display cabinet according to claim 7, wherein the product space of the temperature controlled display cabinet comprising the shelf part and the chest part forms a continuous space.

11. The temperature-controlled display cabinet according to claim 1, wherein the temperature-controlled display cabinet is a semi-vertical display cabinet.

12. The temperature-controlled display cabinet according to claim 1, wherein the opening and closing mechanism further comprises a turning arm mechanism.

13. The temperature-controlled display cabinet according to claim 12, wherein the turning arm mechanism comprises at least one telescopic arm that is arcuate.

14. The temperature-controlled display cabinet according to claim 13, wherein the opening and closing mechanism is attached to a frame part of the door and is attached to the door such that when the door is in a closed position, the opening and closing mechanism is located inside the temperature-controlled display cabinet.

15. The temperature-controlled display cabinet according to claim 12, the opening and closing mechanism is attached to a frame part of the door and is attached to the door such that when the door is in a closed position, the opening and closing mechanism is located inside the temperature-controlled display cabinet.

16. The temperature-controlled display cabinet according to claim 15, wherein the opening and closing mechanism is located on the upper part of the door such that the spring mechanism and the hydraulic system are attached to an upper horizontal frame part of the door frame and correspondingly the turning arm mechanism is attached to the upper horizontal part of the door.

17. The temperature-controlled display cabinet according to claim 16, wherein the horizontal upper door frame is provided with an opening through which the turning arm mechanism extends from the door to be connected inside the temperature-controlled display cabinet on the door frame inside-located spring mechanism and the hydraulic system in order to connect the function of the spring mechanism and the hydraulic system to the opening/closing movement of the door.

18. The temperature-controlled display cabinet according to claim 15, wherein the horizontal upper door frame is provided with an opening through which the turning arm mechanism extends from the door to be connected inside the temperature-controlled display cabinet on the door frame inside located spring mechanism and the hydraulic system in order to connect the function of the spring mechanism and the hydraulic system to the opening/closing movement of the door.

19. The temperature-controlled display cabinet according to claim 1, characterized wherein the hydraulic system and the spring mechanism are located sequentially.

20. The temperature-controlled display cabinet according to claim 1, wherein the hydraulic system and the spring mechanism are located at least partially lengthwise within each other.

* * * * *